US008613331B2

(12) United States Patent
Desai

(10) Patent No.: US 8,613,331 B2
(45) Date of Patent: Dec. 24, 2013

(54) ON DEMAND ACTUATION SYSTEM

(75) Inventor: Praful C. Desai, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 731 days.

(21) Appl. No.: 12/694,489

(22) Filed: Jan. 27, 2010

(65) Prior Publication Data

US 2010/0126730 A1 May 27, 2010

Related U.S. Application Data

(62) Division of application No. 12/170,158, filed on Jul. 9, 2008, now Pat. No. 7,699,120.

(51) Int. Cl.
*E21B 10/32* (2006.01)

(52) U.S. Cl.
USPC ..... 175/263; 175/24; 175/48; 175/38; 166/381; 166/373

(58) Field of Classification Search
USPC ..... 166/250.01, 373, 378, 381, 66; 175/24, 175/38, 40, 48, 263, 267, 57
See application file for complete search history.

(56) References Cited

U.S. PATENT DOCUMENTS

| | | | |
|---|---|---|---|
| 2,822,150 | A | 2/1958 | Muse et al. |
| 4,784,223 | A | 11/1988 | Worrall et al. |
| 5,368,114 | A | 11/1994 | Tandberg et al. |
| 5,526,884 | A | 6/1996 | Lembcke |
| 5,558,153 | A | 9/1996 | Holcombe et al. |
| 5,560,426 | A | 10/1996 | Trahan et al. |
| 5,732,776 | A | 3/1998 | Tubel et al. |
| 5,853,054 | A | 12/1998 | McGarian et al. |
| 6,006,832 | A | 12/1999 | Tubel et al. |
| 6,041,857 | A | 3/2000 | Carmody et al. |
| 6,241,028 | B1 | 6/2001 | Bijleveld et al. |
| 6,364,037 | B1 | 4/2002 | Brunnert et al. |

(Continued)

FOREIGN PATENT DOCUMENTS

| | | | |
|---|---|---|---|
| GB | 2397839 | A | 8/2004 |
| GB | 2439234 | A | 12/2007 |
| GB | 2461632 | A | 1/2010 |
| WO | 2008/150290 | A1 | 12/2008 |

OTHER PUBLICATIONS

Independent Search Report regarding U.S. Appl. No. 12/499,674 and Patent # 7,699,120 dated Feb. 27, 2009. 12 pages.

(Continued)

*Primary Examiner* — Shane Bomar
*Assistant Examiner* — Elizabeth Gitlin
(74) *Attorney, Agent, or Firm* — Osha · Liang LLP

(57) ABSTRACT

A method of selectively actuating a downhole tool, wherein the downhole tool includes a tubular body with an axial borehole therethrough and at least one component, includes increasing a flow rate of a circulating fluid in the axial borehole of the downhole tool to reach a specified circulating fluid pressure, detecting an increased circulating fluid pressure in the borehole of the tool with at least one sensor, actuating a motor to operate a pump, and sending a fluid to operate a sliding sleeve. The method further includes operating the sleeve disposed in the axial borehole to open an actuation chamber port in response to the increased circulating fluid pressure in the borehole of the tool, thereby filling an actuation chamber with the drilling fluid, and moving the at least one expandable component radially outward.

10 Claims, 4 Drawing Sheets

(56) References Cited

U.S. PATENT DOCUMENTS

| | | | | |
|---|---|---|---|---|
| 6,612,547 | B2 | 9/2003 | Carmody et al. | |
| 6,659,200 | B1 | 12/2003 | Eppink | |
| 6,702,025 | B2 | 3/2004 | Meaders | |
| 6,732,817 | B2 | 5/2004 | Dewey et al. | |
| 6,736,213 | B2 | 5/2004 | Bussear et al. | |
| 6,873,267 | B1 | 3/2005 | Tubel et al. | |
| 6,926,089 | B2 | 8/2005 | Goodson, Jr. et al. | |
| 6,929,076 | B2 | 8/2005 | Fanuel et al. | |
| 6,994,172 | B2 | 2/2006 | Ray | |
| 7,036,611 | B2 | 5/2006 | Radford et al. | |
| 7,150,318 | B2 | 12/2006 | Freeman | |
| 7,156,181 | B2 * | 1/2007 | Moore et al. | 166/381 |
| 7,159,662 | B2 | 1/2007 | Johansen et al. | |
| 7,201,230 | B2 | 4/2007 | Schultz et al. | |
| 7,252,152 | B2 | 8/2007 | LoGiudice et al. | |
| 7,308,937 | B2 | 12/2007 | Radford et al. | |
| 7,314,099 | B2 | 1/2008 | Dewey et al. | |
| 7,316,277 | B2 | 1/2008 | Jeffryes | |
| 7,328,755 | B2 | 2/2008 | Hall et al. | |
| 7,337,850 | B2 | 3/2008 | Contant | |
| 7,426,964 | B2 | 9/2008 | Lynde et al. | |
| 7,430,153 | B2 | 9/2008 | Fraser et al. | |
| 7,434,613 | B2 | 10/2008 | Restarick et al. | |
| 2001/0054505 | A1 | 12/2001 | Carmody et al. | |
| 2003/0155155 | A1 | 8/2003 | Dewey et al. | |
| 2004/0251027 | A1 | 12/2004 | Sonnier et al. | |
| 2006/0096786 | A1 | 5/2006 | Wells | |
| 2006/0118304 | A1 | 6/2006 | Ohmer | |
| 2006/0207797 | A1 | 9/2006 | Dewey et al. | |
| 2007/0056724 | A1 | 3/2007 | Spring et al. | |
| 2008/0115574 | A1 * | 5/2008 | Meek | 73/152.03 |
| 2008/0128169 | A1 | 6/2008 | Radford et al. | |

OTHER PUBLICATIONS

Examination Report issued in corresponding British Patent Application No. GB1010946.0; Dated Jun. 27, 2011 (2 pages).

UKIPO's combined search and examination report for corresponding UK patent application # GB0911704.5 dated Oct. 12, 2009. 6 pages.

Office Action issued in related U.S. Appl. No. 12/499,674; Dated Feb. 29, 2012 (8 pages).

* cited by examiner

ON DEMAND ACTUATION SYSTEM

CROSS-REFERENCE TO RELATED APPLICATIONS

This application is a divisional application of U.S. patent application Ser. No. 12/170,158, entitled "On Demand Actuation System," filed Jul. 9, 2008, and incorporated herein by reference in its entirety.

BACKGROUND

1. Field of the Disclosure

Embodiments disclosed herein relate generally to an actuation system for a downhole tool. In particular, embodiments disclosed herein relate to an actuation mechanism of a downhole tool to selectively open and close components of the tool.

2. Background Art

In the drilling of oil and gas wells, concentric casing strings may be installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas may be reduced. Therefore, to increase the annular space for the cementing operation, and to increase the production flow area, it may be desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation may be reached with comparatively larger diameter casing, thereby providing more flow area for the production of oil and gas.

Various methods have been devised for passing a drilling assembly, either through a cased borehole or in conjunction with expandable casing to enlarging the borehole. One such method involves the use of an expandable underreamer, which has basically two operative states. A closed or collapsed state may be configured where the diameter of the tool is sufficiently small to allow the tool to pass through the existing cased borehole, while an open or partly expanded state may be configured where one or more arms with cutters on the ends thereof extend from the body of the tool. In the latter position, the underreamer enlarges the borehole diameter as the tool is rotated and lowered in the borehole. During underreaming operations, depending upon operational requirements of the drilling assembly, cutter blocks of the underreamer may be extended or retracted while the assembly is downhole.

Movement of the cutter blocks typically involves manipulating a sleeve that is used to open or close ports to allow fluid to activate and expand the cutter blocks of the underreamer. In certain prior art applications, the sleeve is held in place with shear pins, and a ball drop device may be used to shear the pins and thereby increase pressure in the tool to move the sleeve and open the cutter block activation ports. However, once the pins are sheared, the tool stays open for the duration of the drilling interval. Therefore, such a configuration may only allow one open cycle. This is also applicable in other tools which may be expanded, including but not limited to, cutting tools, spearing tools, and expandable stabilizers. Accordingly, there exists a need for an apparatus to allow the components of expandable tools to open and close multiple times while the tool is downhole.

SUMMARY OF THE DISCLOSURE

In one aspect, embodiments disclosed herein relate to a downhole tool including a tubular body having an upper connection and a lower connection and an axial borehole therethrough, wherein the upper and lower connections are configured to connect to a drilling assembly, at least one expandable component coupled to the tubular body and configured to selectively extend radially therefrom, and an actuation mechanism configured to selectively extend the at least one component in response to a change in a circulating fluid pressure in the axial borehole.

In other aspects, embodiments disclosed herein relate to a method of selectively actuating a downhole tool, wherein the downhole tool includes a tubular body with an axial borehole therethrough and at least one component, the method including increasing a flow rate of a circulating fluid in the axial borehole of the downhole tool to reach a specified circulating fluid pressure, detecting an increased circulating fluid pressure in the borehole of the tool with at least one sensor, actuating a motor to operate a pump, and sending a fluid to operate a sliding sleeve. The method further includes operating the sleeve disposed in the axial borehole to open an actuation chamber port in response to the increased circulating fluid pressure in the borehole of the tool, thereby filling an actuation chamber with the drilling fluid, and moving the at least one expandable component radially outward.

In other aspects, embodiments disclosed herein relate to a reaming system for a downhole tool, the reaming system including a main body of the tool, a sleeve having at least one sleeve port configured to align with at least one actuation port in the main body, and at least one sensor configured to measure a circulating fluid pressure through a bore of the tool, wherein the sensor is configured to detect an increased circulating fluid pressure in the bore, and further to send a signal to operate the sleeve, and wherein cutter blocks are selectively expanded and retracted in response to an increased circulating fluid pressure in the bore.

Other aspects and advantages of the invention will be apparent from the following description and the appended claims.

DETAILED DESCRIPTION

In one aspect, embodiments disclosed herein relate to an actuation system for a downhole tool, and more particularly, an actuation system used in a downhole tool to selectively open and close expandable components of the tool.

Figure 1:
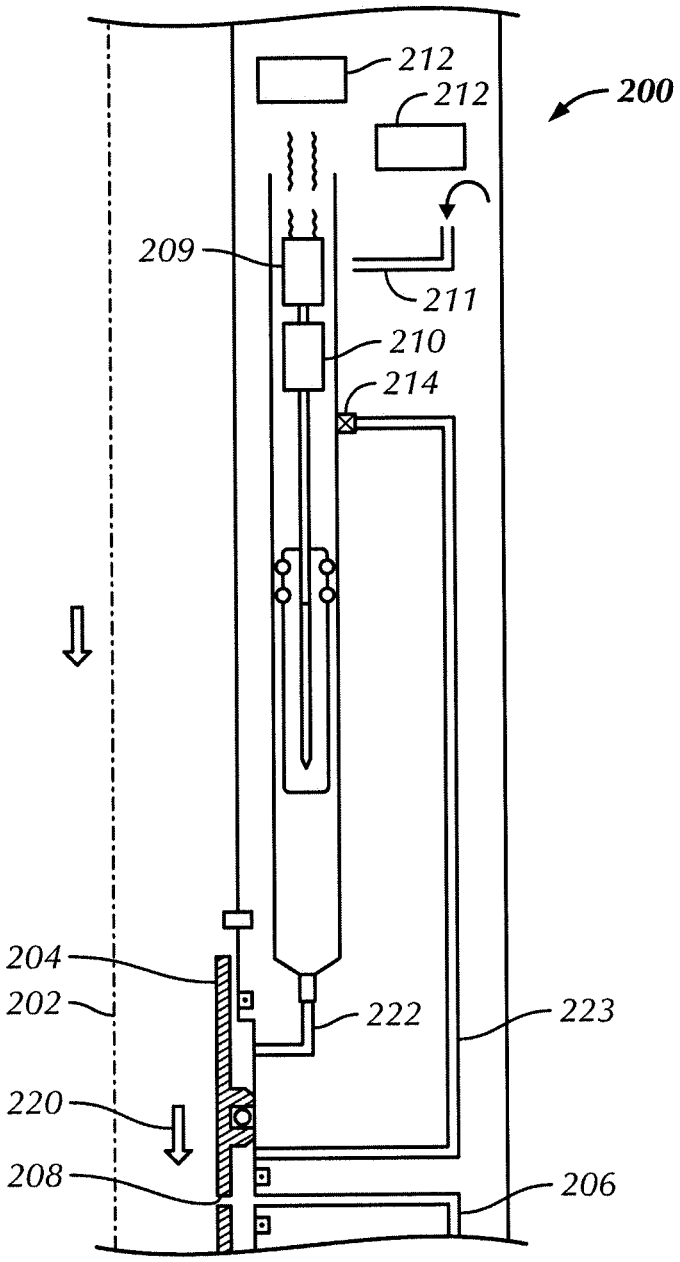
FIG. 1 is section view of an actuation system in a tool in accordance with embodiments of the present disclosure.

Referring now to FIG. 1, a section view of an actuation system in a downhole tool is shown in accordance with embodiments of the present disclosure. The actuation system 200 is configured to selectively open or close expandable components (not shown) of the tool multiple times while downhole. A sliding sleeve 204 is located within an axial bore 202 of a main body of the tool and includes a sleeve port 208. Sleeve port 208 is configured to align with an actuation chamber port 206 which is in fluid communication with an actuation chamber (not shown). This alignment allows a circulating fluid 220 in bore 202 to actuate the expandable components of the tool. As shown, sliding sleeve 204 is operable between a closed position and an open position. As used herein, the closed position is when circulating fluid 220 is not in fluid communication with chamber actuation port 206. The open position is when circulating fluid 220 is in fluid communication with chamber actuation port 206, and is allowed to actuate the expandable components of the tool.

Actuation system 200 also includes sensors 212 that detect increased pressures of circulating fluid 220 in bore 202 during operation. The sensors used to measure and indicate increased pressure of the circulating fluid in the bore of the tool may be commonly used pressure transducers known to those skilled in the art. For example, in certain embodiments, a pressure transducer, having available pressure ranges from 1000 psi to 20,000 psi, may be used with the actuation system. Further, in selected embodiments, flow rate sensors may be used to measure and indicate an increased flow rate of the circulating fluid in the tool bore.

In select embodiments, the sensors may be configured to measure and indicate an increased weight on the expandable components of the tool. Weight sensors, for example a load cell, may detect the increased weight and send the signal to turn on the pump and operate the sleeve. The load cell may detect a preset weight limit that is set by one skilled in the art.

Further, actuation system 200 includes a pump 210 that is coupled to a motor 209 in the downhole tool. Pump 210 uses fluid stored in a reservoir 211 to operate sliding sleeve 204 between the open and closed positions. A toggle switch 214 may be used to route fluid between a first fluid path 222 and second, or reverse, fluid path 223. As used herein, the toggle switch may be defined as a valve to control the direction of fluid from the pump either to the first fluid path 222 or the reverse fluid path 223. Those skilled in the art will understand any number of electric pumps may be used. For example, in select embodiments, a pump supplied by Bieri Swiss Hydraulics may be used. Further, in select embodiments, a DC motor supplied by MicroMo Electronics may be used; however, those skilled in the art will understand any number of electric motors may be suitable.

Figure 2:
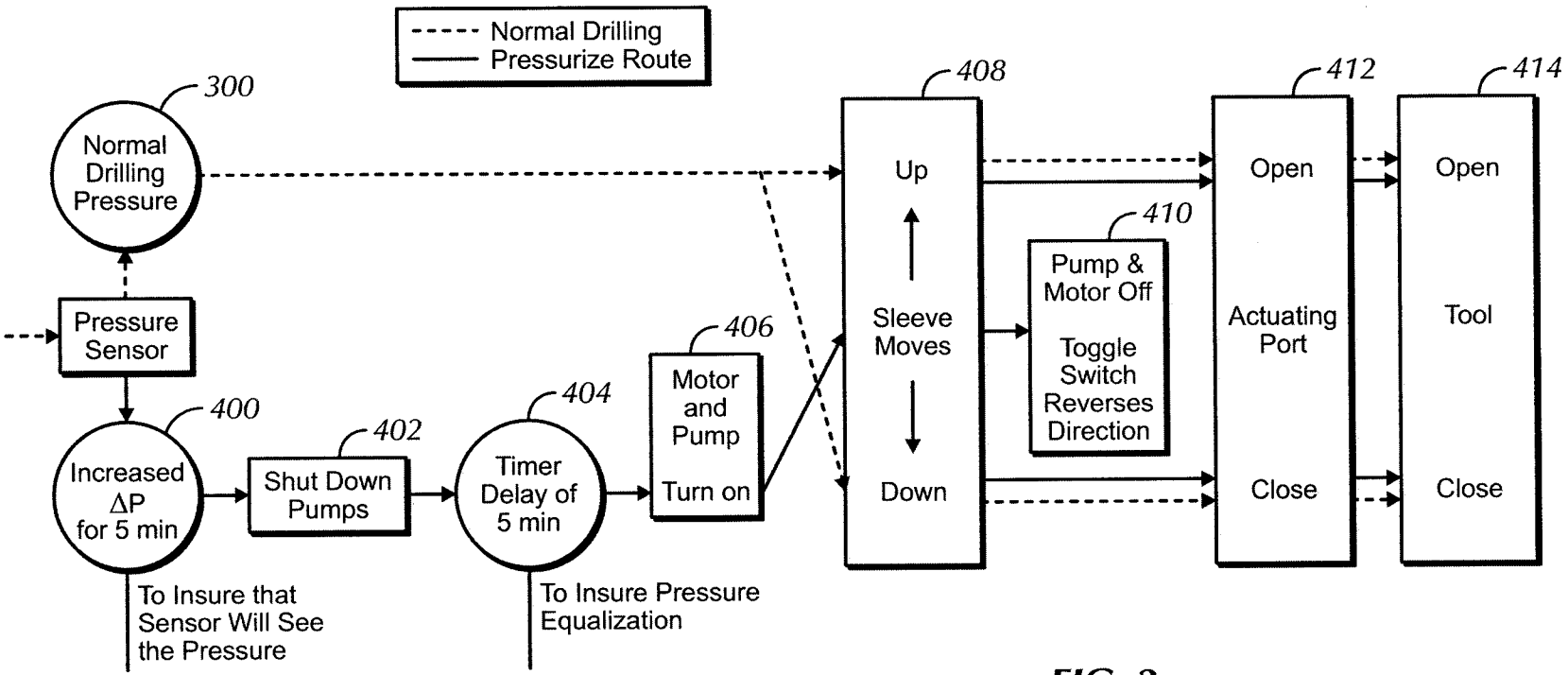
FIG. 2 shows the general system logic of an actuation system in accordance with embodiments of the present disclosure.

Referring to FIG. 2, a logic flowchart of actuating expandable components of a downhole tool is described in accordance with embodiments of the present disclosure. During a majority of the operation, the tool experiences a normal circulating pressure 300 in the bore and operates with the expandable components either open or closed. To commence operation of the actuation system and expand the components, the circulating pressure in the bore may be increased above a specified point so that the pressure sensor may detect this increased circulation pressure 400. To ensure that the pressure sensor detects the increased pressure, the circulation pressure may remain at this level for a certain time period. The time period for the circulation pressure to remain at this increased pressure may range from 2-6 minutes, or as determined by those skilled in the art. This removes the possibility of "accidentally" actuating the system due to an unforeseen pressure spike or other anomaly. Once the circulation pressure has remained at the increased circulation pressure for the specified time period, circulation pumps on the rig may be shut off 402, and the pressure may be allowed to equalize in the bore before proceeding 404.

At this point, the coupled motor and pump are turned on 406 to actuate the sleeve and move it into the open position 408. Referring back to FIG. 1, fluid from reservoir 211 is pumped down the first fluid path 222 to move sleeve 204 into the open position. Once the sleeve is fully moved, the pump and motor are turned off. The toggle switch is used to re-route fluid from reservoir 211 down the reverse fluid path 223. Upon sensing another pressure increase of the circulating fluid, the motor and pump are turned back on and fluid flows down the reverse fluid path 223 to actuate the sleeve and move it back into the closed position.

In alternative embodiments, sleeve 204 may be spring biased and a reduction in fluid pressure at 222 may close port 206. Thus, moving the sleeve into the open position allows the expandable components of the tool to open, and moving the sleeve into the closed position allows the components to retract 414. In certain embodiments, a digital signal processor or integrated circuit board may be used to control the system logic described.

In one embodiment of the present disclosure, the actuation mechanism may be used in conjunction with an underreamer or stabilizer assembly in a downhole tool. In a drilling assembly of embodiments disclosed herein, a drill bit may be mounted onto a lower stabilizer, which may be disposed approximately 5 or more feet above the bit. Typically the lower stabilizer is a fixed blade stabilizer and includes a plurality of concentric blades extending radially outward and azimuthally spaced around the circumference of the stabilizer housing. The outer edges of the blades are adapted to contact the wall of the existing cased borehole, thereby defining the maximum stabilizer diameter that will pass through the casing. A plurality of drill collars extends between the lower and other stabilizers in the drilling assembly. An upper stabilizer is typically positioned in the drillstring approximately 30-60 feet above the lower stabilizer.

Figure 3A:
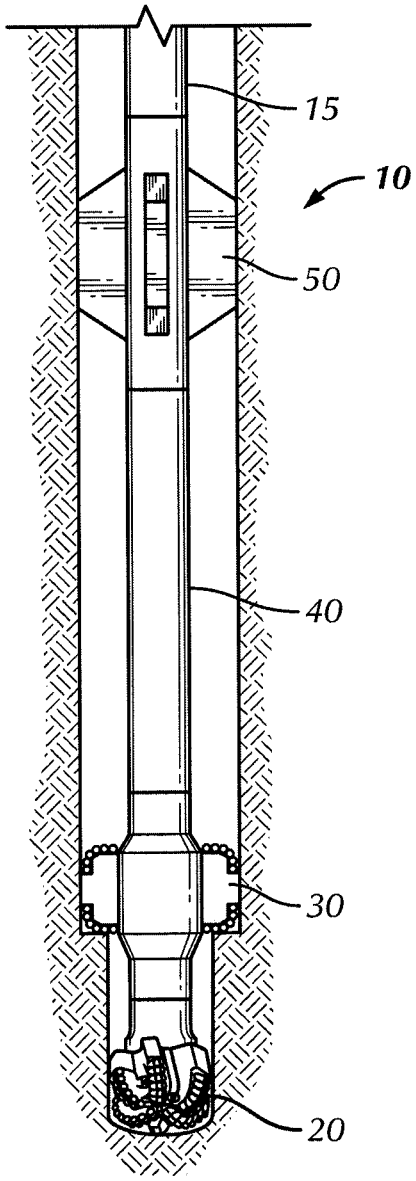
FIGS. 3A and 3B show a drillstring with an underreamer.
Figure 3B:
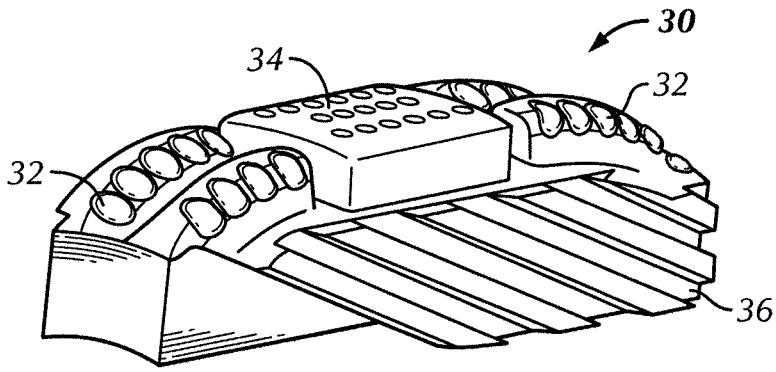

A drilling apparatus 10 is shown in FIGS. 3A and 3B in accordance with embodiments of the present disclosure. Drilling apparatus includes a drill bit 20 disposed on the distal end of a drillstring 15, an expandable lower stabilizer/underreamer assembly 30, a drill collar 40, and an upper stabilizer 50. FIG. 3B shows expandable underreamer 30 which includes cutting elements 32 and a stabilizer pad 34. Expandable underreamer 30 is configured to travel along grooves 36 during expansion or retraction of the arms. In this embodiment, actuation mechanism disclosed herein may be used to extend expandable stabilizer/underreamer arms.

Figure 4A:
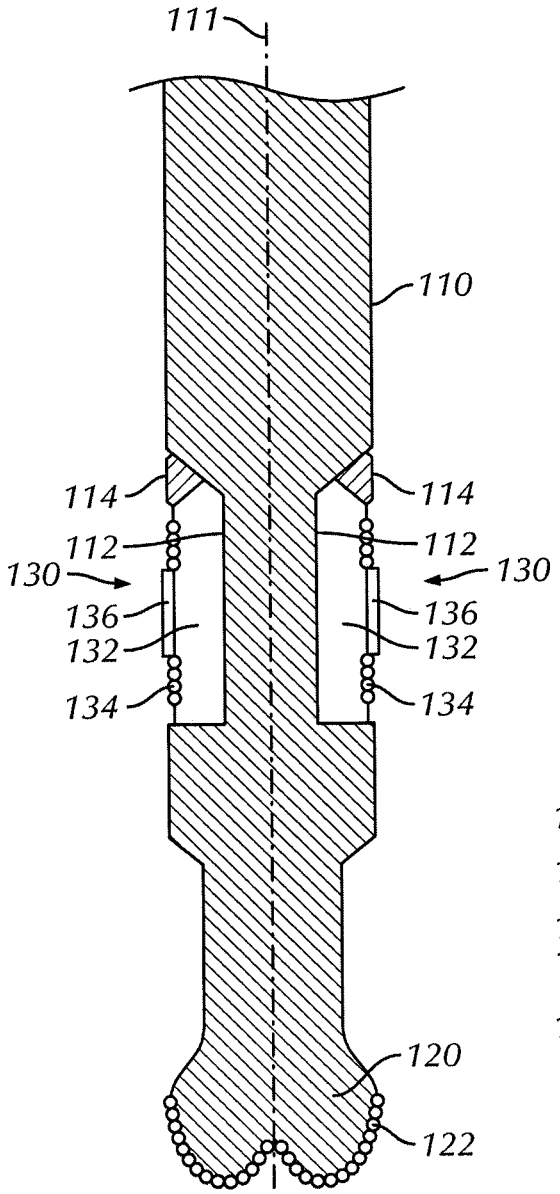
FIGS. 4A and 4B show an underreamer in a retracted and expanded position in accordance with embodiments of the present disclosure.
Figure 4B:
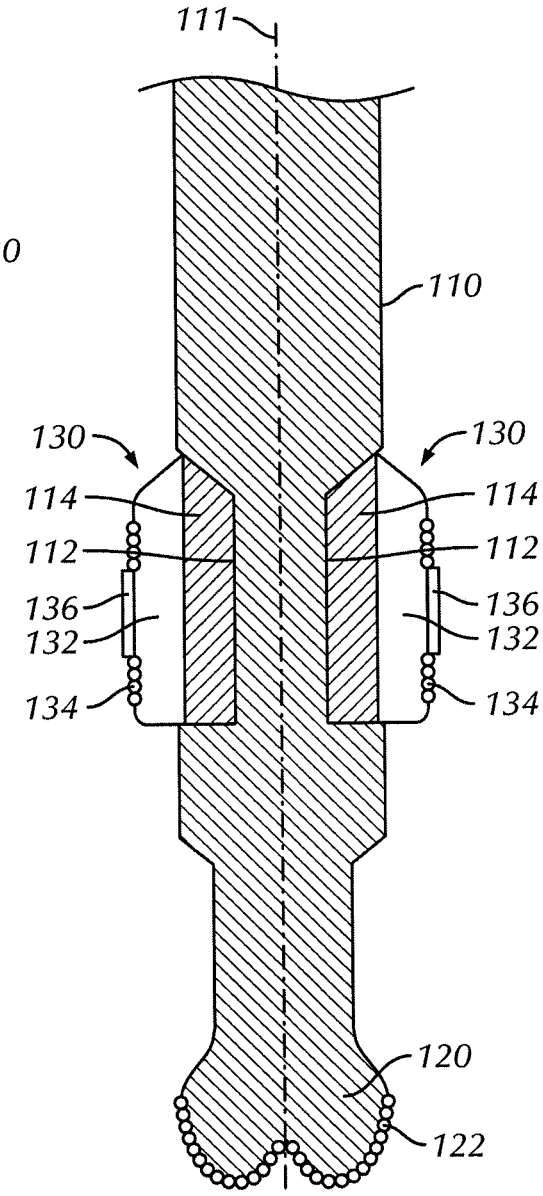

Referring to FIGS. 4A and 4B, a section view of a lower end of another drilling assembly 100 is shown in accordance with embodiments of the present disclosure. Drilling assembly 100 is shown having a substantially tubular main housing 110 having a central axis 111, a cutting head 120, and an expandable underreamer 130. Cutting head 120 includes a plurality of cutting elements, or polycrystalline diamond compact ("PDC") cutters 122. Housing 110 of drilling assembly 100 includes a plurality of axial recesses 112 in which cutter blocks 132 of underreamer 130 are located. Arm assemblies 132 include cutting elements 134, and in certain embodiments, also include stabilizer pads 136.

Cutter blocks 132 may travel from their retracted position (FIG. 4A) to their extended position (FIG. 3B) along a plurality of grooves 114 within the wall of axial recesses 112. Corresponding grooves (not shown) of cutter blocks 132 engage grooves 114 and guide cutter blocks 132 as they traverse in and out of axial recesses 112. One of ordinary skill in the art will understand that any number of cutter blocks 132 may be employed, from a single cutter block 132 to as many cutter blocks 132 as the size and geometry of housing 110 may accommodate. Furthermore, while each cutter block 132 is depicted with both stabilizer pads 136 and cutting elements 134, it should be understood that cutter blocks 132 may include stabilizer pads 136, cutting elements 134, or a combination thereof in any proportion appropriate for the type of operation to be performed. Those skilled in the art will further understand alternative cutter block configurations, including a pivot-type cutter block.

During drilling operations, cutting head 120 is designed and sized to cut a pilot bore, or a bore that is large enough to allow drilling assembly 100 in its retracted state (FIG. 4A) and remaining components of the drillstring to pass therethrough. In circumstances where the borehole is to be extended below a string of casing, the geometry and size of cutting structure 120 and housing 110 is such that entire drilling assembly 100 may pass clear of the casing string without becoming stuck. Once clear of the casing string, or when a larger diameter borehole is desired, cutter blocks 132 may be extended and cutting elements 134 disposed thereupon (in conjunction with stabilizer pads 136) underream the pilot bore to the final gauge diameter.

During underreaming operations, the circulating pressure of fluid 220 through the tool may be affected by the depth of the hole, the type or hardness of the formation being drilled, the pump and rig equipment, and other variables known to those skilled in the art. Initially, a drilling operator may increase the circulating pressure in the bore of the tool to a specified pressure limit. The preset pressure limit may depend on several factors, including but not limited to, the depth of the hole and the fluid flow rate, and will be understood by those skilled in the art. The operator will understand procedures and circumstances for increasing the circulating pressure in the tool bore. Referring back to FIG. 1, sensor 212 detects the increased pressure and sends an electronic signal to start motor 209. Motor 209 may be run off of battery power. Further, motor 209 causes pump 210 to start which sends fluid from reservoir 211 to operate sleeve 204. The alignment between sleeve port 208 and chamber actuation port 206 allows fluid to actuate and expand the cutter blocks of the underreamer.

Once the tool is in the open position, it may remain open until the next time the sensors indicate a circulating pressure increase that exceeds the preset pressure limit. During the next circulating pressure increase cycle, fluid flow may be reversed and the sliding sleeve may be moved in the opposite direction to move the sleeve port and chamber actuation port out of alignment and the sleeve into the closed position. The close position prevents fluid flow to the cutter blocks and allows them to retract. Thus, the opened and closed cycles follow each other every time there is a circulating pressure increase in the tool bore. This arrangement provides an "on demand" open and close feature which is operated by manipulating circulating pressure in the tool bore in conjunction with the sensor based mechanism integral in the tool.

Embodiments of the present disclosure may also be used with any type of cutting and spearing device. Generally, cutting devices may be any type of cutting device capable of cutting casing known in the art. Cutting devices typically include a plurality of arms that may be actuated to extend from the body of the cutting device to engage casing. Spearing devices may include any type of downhole tool capable of internally engaging casing, thereby allowing for removal of the casing from the wellbore. Such spearing devices typically are hydraulically activated, such that a flow of fluid through the tool causes an engagement surface to radially extend into contact with a casing segment. These types of devices are fully described in a co-pending application Ser. No. 12/170,362. This application is fully incorporated herein by reference. The actuation system disclosed herein may be configured to selectively actuate the expandable components of these devices.

In certain embodiments, multiple actuation systems may be used to operate multiple tools downhole, or multiple features of a downhole tool. For example, in some instances, a downhole tool may include multiple cutting devices, spearing devices, and/or jarring devices. The tool may further include additional components, such as jarring accelerators, packers, and/or stabilizers. The multiple casing cutters may allow multiple casing cuts to be made in a single trip, or may serve as back-up cutters in case the first cutter fails. Multiple spearing devices may allow more than one casing segment to be removed from the wellbore on a single trip.

In certain embodiments, the actuation system may include a sleeve that has multiple sleeve ports that are configured to align with multiple chamber actuation ports for different components on the tool. In the open position, the sleeve ports may all align with chamber actuation ports, and therefore allow fluid to actuate and expand the components of the multiple tools. For example, both a cutting device and spearing device may be actuated simultaneously to cut a segment of casing and remove it from the wellbore. In other embodiments, the actuation system may be used to simultaneously expand and retract multiple stabilizers and an underreamer.

Alternatively, the actuation system may include multiple sleeves that are each individually responsible for actuating a different tool. Therefore, there may be multiple motor and pump combinations which operate the sleeve. In this case, the multiple sleeves may be operated in tandem such that they open together or close together.

Advantageously, embodiments of the present disclosure for the on-demand actuation system may allow multiple open and close cycles by merely manipulating the pump pressure. For example, embodiments of the present disclosure may be configured to continue circulation of fluid through the bore while pulling out of the hole. Further, the ability to operate the actuation system in such a way may greatly increase the efficiency and reduce the costs of the downhole operations. Further, damage to the components of a downhole tool, for example, the arm assemblies of an underreamer or stabilizer, may be prevented due to the ability to selectively open and close them, rather than remaining open in all drilling conditions. This may lead to increased longevity of the tool and reduced costs due to maintenance or equipment failure.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method of selectively actuating a downhole tool, wherein the downhole tool comprises a tubular body with an axial borehole therethrough and at least one expandable component, the method comprising:

increasing a flow rate of a circulating fluid in the axial borehole of the downhole tool to reach a specified circulating fluid pressure;

detecting an increased circulating fluid pressure in the borehole of the tool with at least one sensor;

actuating a motor to operate a pump, thereby sending a fluid to operate a sliding sleeve disposed in the axial borehole;

operating the sliding sleeve to open an actuation chamber port in response to the increased circulating fluid pressure in the borehole of the tool, thereby filling an actuation chamber with the circulating fluid;

moving the at least one expandable component radially outward;

increasing the flow rate of the fluid down through the axial borehole to a specified circulating fluid pressure;

detecting an increase of pressure in the fluid in the axial borehole of the downhole tool; and operating the sleeve disposed in the axial borehole of the downhole tool to close the actuation chamber port, thereby allowing the at least one expandable component to retract.

2. The method of claim 1, further comprising coupling a direct current electric motor with the pump.

3. The method of claim 1, further comprising:

measuring and indicating an increased weight on the expandable component; and operating the sleeve to selectively expand and retract the component in response to the increased weight.

4. A method of selectively actuating a downhole tool, wherein the downhole tool comprises a tubular body with an axial borehole therethrough and at least one expandable component, the method comprising:

increasing a flow rate of a circulating fluid in the axial borehole of the downhole tool to reach a specified circulating fluid pressure;

detecting an increased circulating fluid pressure in the borehole of the tool with at least one sensor;

actuating a motor to operate a pump, and sending a fluid to operate a sliding sleeve;

operating the sliding sleeve disposed in the axial borehole to open an actuation chamber port in response to the increased circulating fluid pressure in the borehole of the tool, thereby filling an actuation chamber with the circulating fluid;

moving the at least one expandable component radially outward;

increasing the flow rate of the fluid down through the axial borehole to a specified circulating fluid pressure;

detecting an increase of pressure in the fluid in the axial borehole of the downhole tool;

operating the sleeve disposed in the axial borehole of the downhole tool to close the actuation chamber port, thereby allowing the at least one expandable component to retract; and reversing the pressurized fluid to move the sleeve into a closed position.

5. A method of selectively actuating a downhole tool, wherein the downhole tool comprises a tubular body with an axial borehole therethrough and at least one expandable component, the method comprising:

increasing a flow rate of a circulating fluid in the axial borehole of the downhole tool to reach a specified circulating fluid pressure;

detecting an increased circulating fluid pressure in the borehole of the tool with at least one sensor;

actuating a motor to operate a pump, and sending a fluid to operate a sliding sleeve;

operating the sliding sleeve disposed in the axial borehole to open an actuation chamber port in response to the increased circulating fluid pressure in the borehole of the tool, thereby filling an actuation chamber with the circulating fluid;

moving the at least one expandable component radially outward;

measuring and indicating an increased weight on the expandable component; and operating the sleeve to selectively expand and retract the component in response to the increased weight.

6. A method of selectively actuating a downhole tool, wherein the downhole tool comprises tubular body with an axial borehole therethrough and at least one expandable component, the method comprising:

increasing a flow rate of a circulating fluid in the axial borehole of the downhole tool to reach a specified circulating fluid pressure;

maintaining the increased flow rate for a predetermined time period;

detecting an increased circulation fluid pressure in the axial borehole of the downhole tool with at least one sensor;

stopping the flow rate of circulation fluid after a predetermined time period thus allowing circulating fluid pressure to equalize;

actuating a motor in response to a signal from the sensor to operate a pump, sending a fluid from a reservoir to operate a sliding sleeve;

operating the sleeve disposed in the axial borehole of the downhole tool to open an actuation chamber port, thereby filling an actuation chamber with the circulating fluid;

moving the at least one expandable component radials outward; and turning off the pump and the motor once the sleeve is fully moved measuring and indicating an increased weight on the expandable component; and operating the sleeve by turning on the motor and the pump to selectively expand and retract the expandable component in response to the increased weight.

7. The method of claim 6, further comprising:

increasing a flow rate of the circulating fluid in the axial borehole of the downhole tool to reach a specified circulating fluid pressure;

maintaining the increased flow rate for a predetermined time period;

detecting an increased circulation fluid pressure in the axial borehole of the downhole tool with the sensor;

stopping the flow rate of circulation fluid after predetermined time period thus allowing circulating fluid pressure to equalize;

actuating a motor in response to a signal from the sensor to operate the pump, sending the fluid from the reservoir to operate the sliding sleeve; and operating the sleeve disposed in the axial borehole of the downhole tool to close the actuation chamber port, thereby preventing the circulating fluid from entering the actuation chamber thus allowing the at least one expandable component to retract.

8. The method of claim 7, wherein operating the sleeve further comprising reversing the fluid from the reservoir to move the sleeve causing the actuation chamber port to be closed.

9. The method of claim 8, wherein reversing the fluid is achieved by a toggle switch.

10. The method of claim 6, wherein the increased weight is detected by the sensor.

* * * * *